US005257494A

United States Patent [19]

Parrier et al.

[11] Patent Number: 5,257,494

[45] Date of Patent: Nov. 2, 1993

[54] INSTALLATION FOR THE CONTINUOUS FILLING OF A CASING

[75] Inventors: Jean Parrier; Henri Parrier, both of Saint Genis les Ollieres, France

[73] Assignee: Wogegal SA, Courbevoie, France

[21] Appl. No.: 844,922

[22] Filed: Mar. 3, 1992

Related U.S. Application Data

[63] Continuation of Ser. No. 623,728, Feb. 27, 1991, abandoned.

[30] Foreign Application Priority Data

Apr. 28, 1989 [FR] France ..... 89 05740

[51] Int. Cl.[5] ..... B65B 1/26; B65B 9/10; B65B 43/42

[52] U.S. Cl. ..... 53/523; 53/168; 53/575

[58] Field of Search ..... 53/111 R, 168, 201, 53/250, 253, 523, 526, 528, 575, 576, 577; 141/67

[56] References Cited

U.S. PATENT DOCUMENTS

| | | | |
|---|---|---|---|
| 2,639,069 | 5/1953 | West | 53/253 X |
| 3,040,882 | 6/1962 | Van Beckum et al. | 53/436 X |
| 3,288,153 | 11/1966 | Ballard et al. | 53/253 X |
| 3,406,727 | 10/1968 | Rexus | 53/253 X |
| 3,659,634 | 5/1972 | Ohring | 53/575 X |
| 3,726,954 | 4/1973 | Munk et al. | 141/67 X |
| 3,878,873 | 4/1975 | Willis et al. | 141/67 |
| 3,991,910 | 11/1976 | Leonard | 141/67 X |
| 4,235,067 | 11/1980 | Parsons | 53/253 X |
| 4,495,751 | 1/1985 | Galbiati | 53/576 |
| 4,640,082 | 2/1987 | Gill | 53/528 X |
| 4,649,601 | 3/1987 | Kollross | 53/576 X |
| 4,664,160 | 5/1987 | Rothstein et al. | 141/67 |
| 4,738,287 | 4/1988 | Klinkel | 141/67 X |
| 4,872,493 | 10/1989 | Everman | 141/67 X |

*Primary Examiner*—John Sipos
*Assistant Examiner*—Linda B. Johnson

[57] ABSTRACT

An apparatus for continuously filling tubular casings with a fibrous material such as wood fibers. The tubular casings are closed at one end have plurality of holes in the cylindrical side to allow air to flow therethrough. The apparatus further includes supports for the tubular casings so that a mixture of air and the fibrous material may be suctioned into the tubular casing to form a fiber cake. The apparatus further includes the ability to control the mixture of air and fibrous material to ensure the fiber cake formed has a homogeneous density and the ability to change the mixture of air and fibrous material so that fiber cakes with varying densities may be formed. Further, a binder is applied to the fiber cake and the fiber cake is cut into units. Finally, the apparatus includes the ability to continuously fill tubular casings such that while one fiber cake is being formed by the suction of the air/fibrous material, another fiber cake is being applied with binder and cut into units, such that the operation is a continuous process.

21 Claims, 2 Drawing Sheets

INSTALLATION FOR THE CONTINUOUS FILLING OF A CASING

This application is a continuation of application Ser. No. 07/623,728 filed on Feb. 27, 1991, now abandoned.

This invention relates to an installation for the continuous filling of a casing and, more particularly, the filling of a continuous net by a fibrous material, for example, wood fiber.

The continuous filling of a casing presents certain production problems when it involves such a fibrous material as wood fiber. It is not possible to introduce the fibers in the casing by a piston or other mechanical pusher if it is desired to obtained a regular filling density of the fibers in the casing.

This invention therefore has as its object an installation for the continuous filling of a casing which is of simple design and increased reliability and which assures an approximately homogeneous filling density.

To do this, the invention proposes an installation for the continuous filling of a tubular casing, with a fibrous material, comprising a tubular support around which a casing has been placed, a duct intended to connect the inside of the tubular support to a source of fibrous material and means for transporting the fibrous material between the source and the casing through the duct, characterized in that said transfer means comprise an air current, the installation further comprising means for adjusting the air flow from inside the casing to the outside to control the density of the fibrous material in the casing.

When an attempt is made to cut a casing thus filled with fibrous material, closing the ends of the cut net also poses problems. It cannot be provided to close the net by twisting it in the locations where it is provided to cut it because it is necessary to stop the filling at precise moments to create the spaces spaced along the net.

Another object of the invention is to propose an installation making possible the cutting of the casing filled by units having an approximately regular density.

According to a first characteristic, this object is achieved by the fact that the installation comprises, a nozzle for the spreading of a binder on predetermined zones of the tubular casing once filled, and a cutting station for the filled casing.

Other characteristics and advantages of this invention will be made clearer by the following description, with reference to the accompanying drawings in which.

Figure 1:
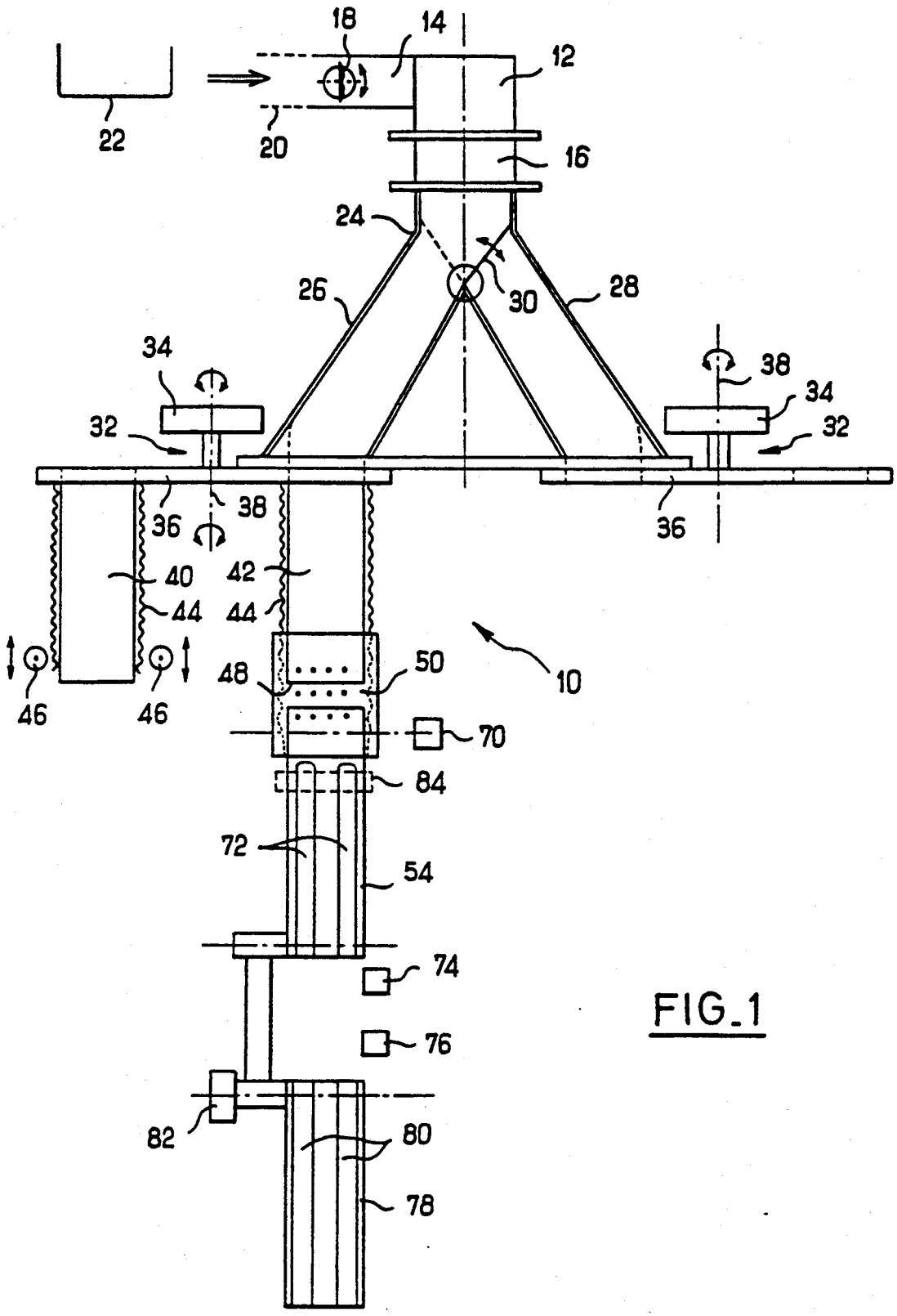
FIG. 1 is a diagrammatic view of an installation for the continuous filling of a casing according to the invention.

As shown in FIG. 1, an installation for the continuous filling of a casing comprises a blower 12 provided with an input 14 and an output 16. Input 14 comprises an adjustable flap 18 whose function will be described below. A hose, shown diagrammatically as 20, connects input 14 to a reserve 22 of fibrous product intended to fill the casing. In the example illustrated, the product comprises wood fiber, the fibers having a length between 0.5 and 10 mm.

Output 16 of blower 12 is connected to a duct 24 which is approximately Y-shaped and comprising two arms 26 and 28. Duct 24 comprises a swinging flap 30 intended to close one or the other of arms 26, 28. In its illustrated position, flap 30 closes passage 28 and leaves passage 26 open. A rotary support 32 is mounted beside the open end of each arm 26 and 28 and comprises a solenoid 34 able to rotate an arm 36 selectively around an axis 38. Arm 36 comprises, at each end and in a symmetrical way, a tubular support 40 and 42 intended to receive casing 44 on its outside surface. In its illustrated position, support 40 is in a position for loading casing 44. Rollers 46, intended to facilitate the placing of casing 44 on support 40, are placed on both sides of the open end of support 40.

In the example illustrated, casing 44 comprises a tubular net of a synthetic material, for example, polyethylene, with meshes having dimensions between 1 and 10 mm.

Figure 2A:
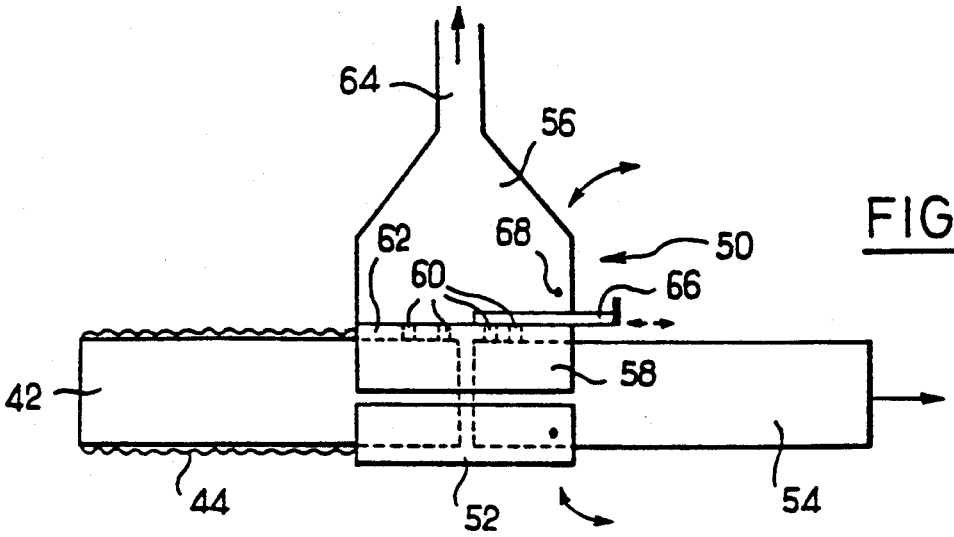
FIGS. 2A and 2B are detailed views of a part of FIG. 1.
Figure 2B:
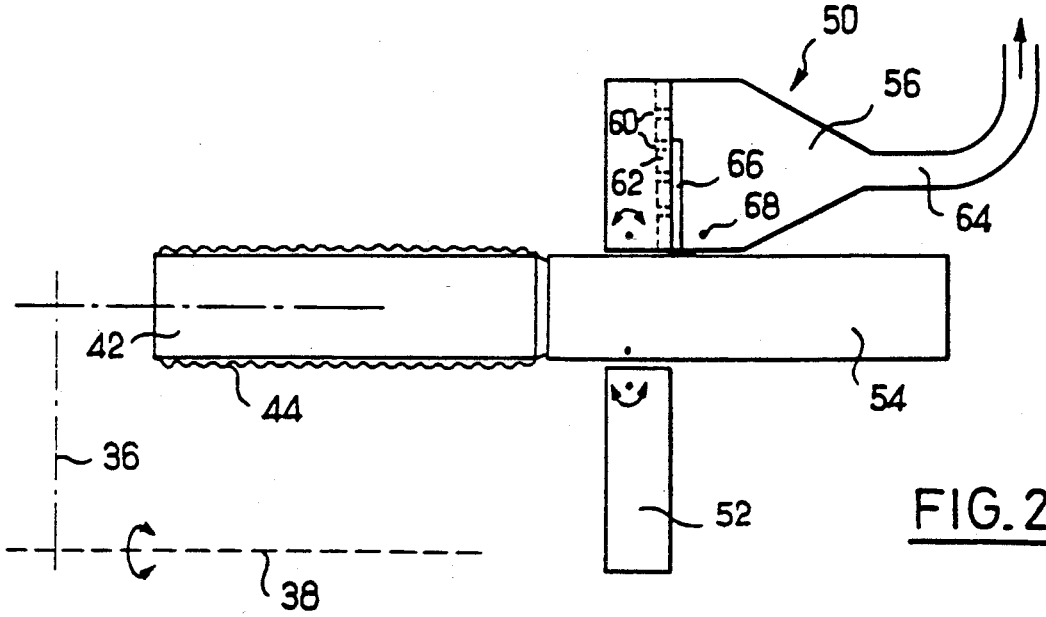

Beside free end 48 of tubular support 42 is mounted a suction unit 50 which is shown in more detail in FIGS. 2A and 2B. Suction device 50 comprises a basic element 52, having a U-shaped section, mounted to pivot on a duct 54, and a hood 56. Hood 56 comprises two sides 58 which, with basic element 52, approximately surround the neighboring ends of tubular support 42 and of duct 54. Openings 60 closed in bottom 62 of hood 56 make possible the passage of air between the end of tubular support 42 and an air output 64. Hood 56 is provided with a flap 66, which can be moved to the right or to the left when looking at the drawing to be able to open or close selectively openings 60 and thus to adjust the air flow evacuated by hood 56. This hood is mounted to pivot on a shaft 68 and can, therefore, be swung with basic element 52 from the position illustrated in FIG. 2A to the position of FIG. 2B to make possible the rotation of tubular support 42 around axis 38. This swinging is assured by a rotary cylinder 70 (see FIG. 1).

Duct 54 has an approximately U-shaped section and comprises means of transport of the casing which, in the example illustrated, are belts 72. A nozzle 74 for the spreading of a binder and a cutting station 76 for the casing, which will be described in more detail below, are placed behind the end of duct 54 opposite suction unit 50. The installation comprises, finally, a second duct 78 analogous to duct 54, which is also provided with conveyor belts 80. Conveyor belts 72 and 80 are started by a variable-speed electric motor 82.

Installation 10 thus described operates as follows. During starting of blower 12, a mixture of air and wood fibers is sucked in by input 14 and passes through output 16 toward the inside of arm 26 of duct 24, flap 30 closing arm 28. Then, the mixture passes inside tubular support 42 and causes the unfolding of net 44. During the start-up of the installation, it is necessary to close the open end of net 44. This closing can optionally be performed manually. The fiber cake formed by the filling of the net advances in duct 54 and is carried by belts 72. The cake takes a shape corresponding to the inner section of duct 54. This shape can advantageously be assured by a roller or a guide element 84 placed on duct 54.

Since a mixture of air and fibers which passes through the inside of tubular support 42 is involved, it is necessary that the air be able to leave the net during its filling. This output of air is performed through openings 60. By selecting the degree of closing of openings 60 by flap 66, the filling density of the fibers in the net can be easily adjusted.

Figure 3:
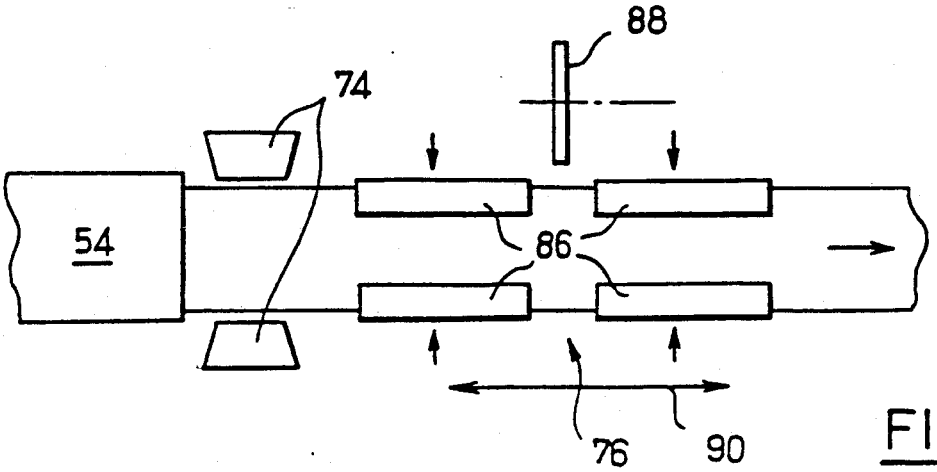
FIG. 3 is a detailed view of another part of FIG. 1.

The net thus filled with wood fibers passes through duct 54 to nozzle 74 which applies a layer of binder around the periphery of the net. As the net moves, nozzle 74 is placed so as to move at the same time as the net during the spreading of the binder. The function of the binder is to assure that, during the cutting of the cake, the end of each cake remains intact without loss of fibers. In a preferred embodiment, the binder is paraffin which is heated to a temperature of about 60° C. The paraffin is applied around the net to form a belt of a 4-cm width. The paraffin does not penetrate to the center of the net but a penetration of about 1 cm is sufficient for the cakes to remain intact during the cutting. A preferred embodiment, comprising two nozzles 74, is shown in FIG. 3.

There can be used glues, preferably biodegradable glue or else a "contact" glue with a split-second setting with a pine resin base, for example, applied with the help of a fiberization system so that the glue attaches, the net so that the latter does not retract at the time of the cutting, and, so the fibers at the ends do not fall.

A system of spray nozzles, not shown here, can also be provided to blow this glue with split-second setting on the ends of the cakes after the cutting to assure the holding of the fibers to said ends.

After the spreading of the paraffin, the cake is cut into units. In the embodiment of FIG. 3, the cake is first clamped by cylinders 86 before being cut by a cutting disk 88. As in the case of the spreading nozzle, cylinders 86 and cutting disk 88 are placed to follow the movement of the cake to assure a normal cutting in the longitudinal axis of the cake. At the end of each cutting, the group of nozzles 74, cylinders 86 and disk 88 returns to its initial position as shown by arrow 90. The cut cakes pass through second duct 78 toward a packaging station (not shown) where they are put into a plastic packaging.

This installation is intended to assure a continuous filling of the net. Since the length of net which can be loaded on tubular support 42 is limited, installation 10 comprises a second filling chain which is approximately analogous to that shown in FIG. 1 and can assure the production of cakes while a length of net is sought on the tubular support of the other chain. When the net on the tubular support is almost used up, flap 30 is rotated and comes to close arm 26 thus making it possible for the air/fiber mixture to pass through arm 28 and to fill the net on the other filling chain. Since a new length of net has been loaded on tubular support 42, it is sufficient to rotate rotary support 32 to put this loaded support 40 in the place of empty tubular support 42. The first filling chain thus becomes ready to restart during the using up of the net of the other chain. It remains to load a new length of net on tubular support 42.

This installation makes possible the continuous filling of a casing such as a net in a simple and reliable way. Moreover, the adjustment of the air output by openings 60 makes it possible to control the filling density of the fibers in the net easily.

It can be provided to use a net of synthetic material called "memory" or heat-shrinkable which is intended to compress the material slightly after filling.

To assure a better penetration of the binder in the fibers, it can be provided to heat it to a temperature higher than 60° C. In this case, the installation further comprises cooling air nozzles placed between nozzle 74 and cutting station 76 to assure the setting of the binder before the cutting of the cakes.

The installation can assure the continuous filling of a casing by any other fibrous or granular material.

We claim:

1. An installation for continuously and automatically filling a plurality of tubular casings with loose fibrous material, comprising:

tubular supports, around which the plurality of tubular casings has been placed;

a duct separate from the tubular supports, for connecting said tubular supports to a source of the loose fibrous material;

means for transporting the loose fibrous material between the source of the loose fibrous material and one of the plurality of tubular casings through the duct in order to fill the one of the plurality of tubular casings with the loose fibrous material;

means for supplying and adjusting a flow of air current within the duct to control a density of the loose fibrous material in the one of the plurality of tubular casings;

means for rotating said means for transporting such that said means for transporting automatically transports the loose fibrous material between the source of the loose fibrous material and another one of the plurality of tubular casings, thereby providing automatic and continuous filling of the plurality of tubular casings at least one nozzle for spreading a binder on predetermined areas of the plurality of filled casings; and a cutting station for cutting the plurality of filled tubular casings into a plurality of units.

2. The installation according to claim 1, wherein said means for adjusting the air current is a hood, placed around a free end of said tubular support with a plurality of openings for directing the air current.

3. The installation according to claim 2, wherein the hood includes a flap which is movable to selectively open and close said plurality of openings.

4. The installation according to claim 1, wherein the binder is paraffin.

5. The installation according to claim 1, wherein the binder is a glue with split-second setting applied using a fiberization system.

6. The installation according to claim 1, further comprising means for spraying glue on each end of the plurality of units.

7. An apparatus for continuously and automatically filling tubular casings, comprising:

a plurality of tubular casings, closed at one end, with a plurality of holes in a cylindrical side of each tubular casing to allow air to flow therethrough;

means for supporting said plurality of tubular casings;

means for suctioning, connected to said means for supporting, for suctioning a mixture of air and fibrous material into one of said plurality of tubular casings to form a first fiber cake;

means for controlling the mixture of air and fibrous material including means for ensuring a density of the first fiber cake is homogeneous and means for changing the mixture of air and fibrous material so that additional fiber cakes, with varying densities may be formed;

means for applying a binder to the first fiber cake;

means for cutting the first fiber cake into a plurality of units; and means for rotating said means for supporting such that said mean for suctioning automatically suctions the mixture of air and fibrous material into another one of said plurality of tubular casings to form a second fiber cake, at the same time the binder is being applied to and the first fiber cake is being cut into the plurality of units, said means for rotating selectively rotating said means for supporting, thereby providing automatic and continuous filling of the plurality of tubular casings.

8. The apparatus for continuously filling tubular casings of claim 7, wherein said controlling means is a hood, placed around a free end of said means for supporting, with a plurality of openings to direct the mixture of air and fibrous material.

9. The apparatus for continuously filling tubular casings of claim 8, wherein said hood includes a flap which is movable to selectively open and close said plurality of openings.

10. The apparatus for continuously filling tubular casings of claim 9, wherein said plurality of tubular casings are made of a synthetic material such as polyethylene and the plurality of holes have a diameter of 1–10 mm.

11. The apparatus for continuously filling tubular casings of claim 10, wherein said applying means is at least one nozzle for applying the binder to predetermined areas of the first fiber cake, and said cutting means is a cutting station.

12. The apparatus for continuously filling tubular casings of claim 11, wherein the binder is paraffin.

13. The apparatus for continuously filling tubular casings of claim 12, wherein the paraffin is heated to 60° C. before application.

14. The apparatus for continuously filing tubular casings of claim 11, wherein the binder is a glue with split-second setting applied using a fiberization system.

15. The installation according to claim 1, wherein the tubular casings are of a net shaped material.

16. The installation according to claim 15, wherein the means for adjusting the air current includes a blower located in the duct, so that the fibrous material can be compacted within the net casing.

17. The installation according to claim 1, wherein the tubular casings are formed of net material that is folded up, so that said casings are unfolded when they are filled with fibrous material; and means for automatically moving the filled casing to a position for applying a binder to the fibrous material.

18. The installation according to claim 17 further including means for applying a binder only to a selected portion of said fibrous material, so that when the fibrous material is cut the fibrous material will remain intact.

19. The installation according to claim 18, further including means for cutting said fibrous material which contains the binder after the binder has been applied.

20. The installation according to claim 7, wherein said means for supporting are tubular supports around which said tubular casings are placed.

21. The installation according to claim 1, wherein said loose fibrous material is formed of wood fibers.

* * * * *